US005381809A

United States Patent [19]

Parker, Jr.

[11] Patent Number: 5,381,809

[45] Date of Patent: Jan. 17, 1995

[54] TOILET BOWL CLEANING APPARATUS

[76] Inventor: Kenneth B. Parker, Jr., 23516 Bell Bluff Truck Trail, Alpine, Calif. 91901

[21] Appl. No.: 67,347

[22] Filed: May 26, 1993

[51] Int. Cl.[6] ..... B08B 3/02; B08B 9/08

[52] U.S. Cl. ..... 134/113; 134/169 R; 134/188; 134/192; 134/195

[58] Field of Search ..... 134/89, 113, 168 R, 134/169 R, 188, 192, 195; 4/233, 300.3; 68/184; 366/265

[56] References Cited

U.S. PATENT DOCUMENTS

| | | | |
|---|---|---|---|
| 1,699,618 | 1/1929 | Moses | 68/184 |
| 2,180,301 | 11/1939 | Saylor | 366/265 |
| 2,605,478 | 8/1952 | Lassiter | 134/168 R X |
| 3,381,312 | 11/1965 | Whitla . | |
| 3,668,996 | 6/1972 | Peiffer et al. | 134/188 X |
| 3,919,726 | 11/1975 | Godwin et al. . | |
| 4,183,105 | 1/1980 | Womack | 4/233 X |
| 4,216,553 | 8/1980 | Haberle | 4/233 X |
| 4,397,056 | 8/1983 | Miller . | |
| 4,571,752 | 2/1986 | Bick . | |
| 4,890,339 | 1/1990 | Clark | 4/300.3 |
| 4,947,492 | 8/1990 | Vincent . | |
| 5,123,124 | 6/1992 | Brower . | |

FOREIGN PATENT DOCUMENTS

| | | | |
|---|---|---|---|
| 318579 | 1/1930 | United Kingdom | 134/192 |

*Primary Examiner*—Philip R. Coe

*Attorney, Agent, or Firm*—Fulwider Patton Lee & Utecht

[57] ABSTRACT

A powered cleaning apparatus is provided for routine cleaning of both moderately soiled and severely stained toilet bowls. The device comprises a motor, fluid pump, and cover universally mountable on toilet bowls, and provides a continuous recirculated spray of cleaning solution fluid onto all interior toilet bowl surfaces. The continuous contact of cleaning solution fluid cleans the interior bowl surfaces without manual effort.

20 Claims, 4 Drawing Sheets

FIG. 1
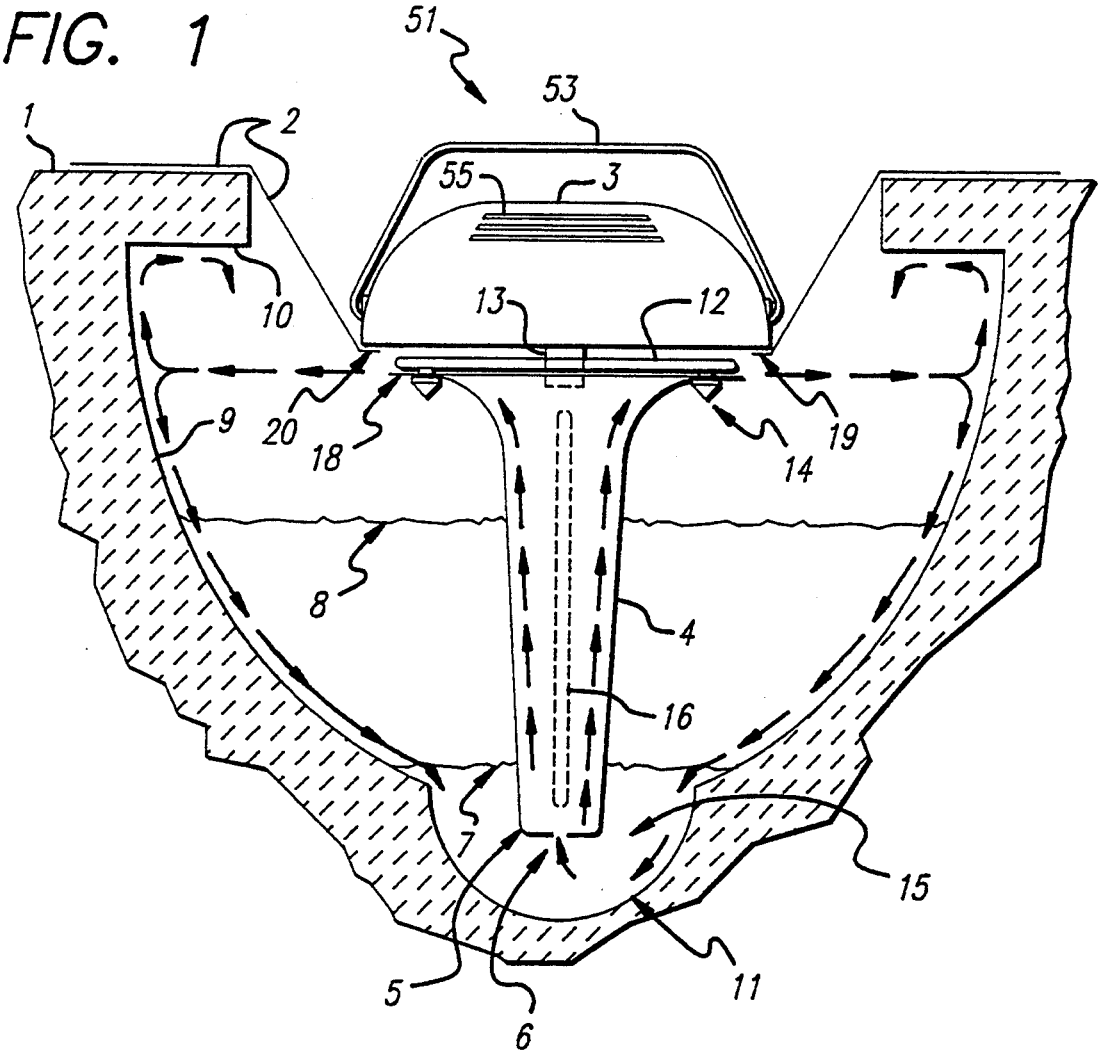
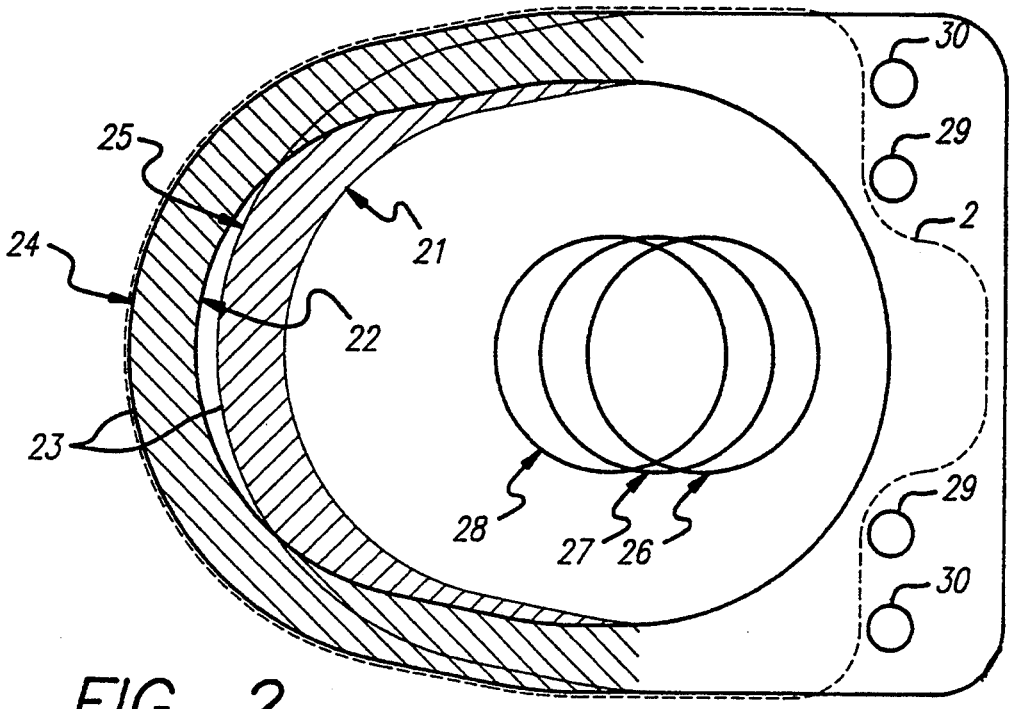
FIG. 2

FIG. 3b
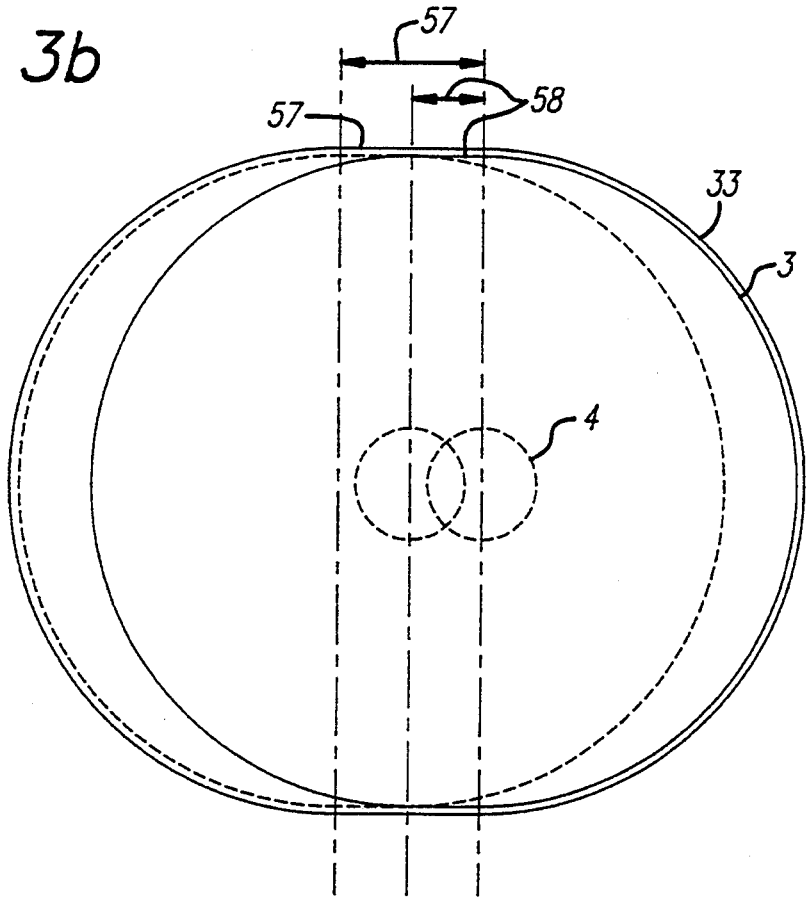
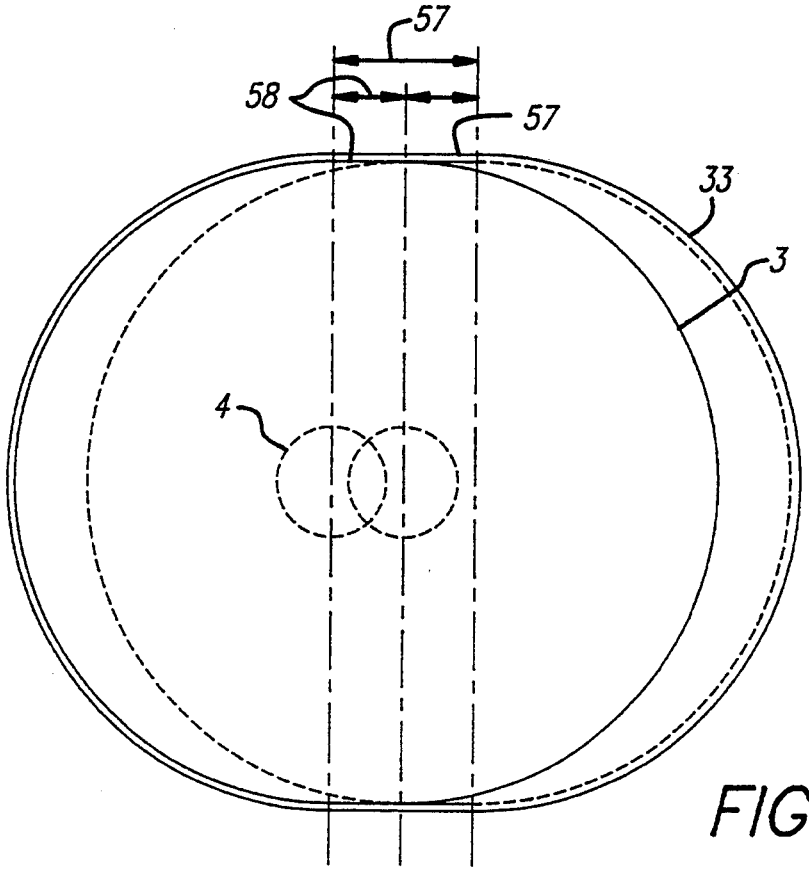
FIG. 3c

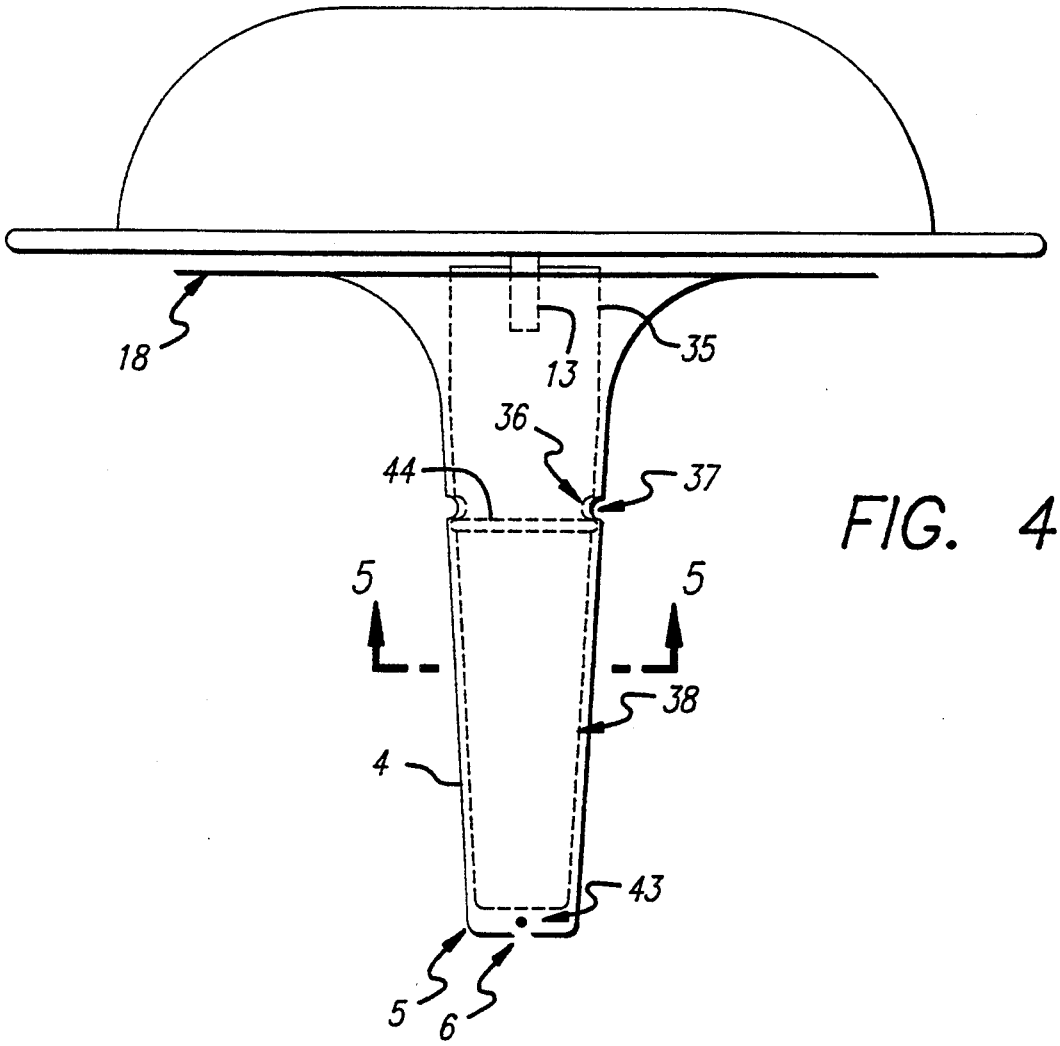
FIG. 4
FIG. 5a
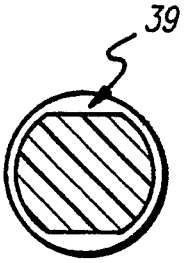
FIG. 5c
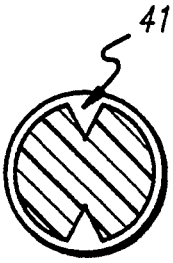
FIG. 5b
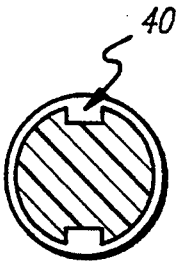
FIG. 5d
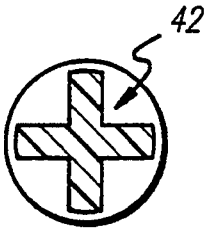

TOILET BOWL CLEANING APPARATUS

BACKGROUND OF THE INVENTION

The invention relates generally to automated cleaning systems for toilets. More particularly, the invention relates to such a system that is portable from toilet to toilet.

During routine use, toilet bowls become soiled and require periodic cleaning. In cases where water used for flushing does not contain sediment or dissolved minerals, cleaning can be accomplished by applying cleaning solution or powder to the interior of the bowl, followed by manual brushing and rinsing. This task is generally considered difficult and unpleasant.

Solutions containing germicides to sanitize the toilet bowl surfaces for disease control may also be used. In such cases, it is important to apply solution to all surfaces including the hard and sometimes unpleasant to reach surfaces under the edge or lip of the rim of the bowl. This cleaning for disease control is particularly critical in situations involving persons with AIDS and other immune system disorders who are particularly susceptible to infection.

Cleaning under the lip of the rim of the bowl requires some entry into the bowl to see the underside of the rim, or alternatively some tactile contact with the under lip surface is needed to ascertain that adequate cleaning is accomplished. It has been recognized that this also is difficult and unpleasant, and hence those concerned with the art have sought to mitigate this unpleasant task. To aid in this effort, some toilet cleaning brushes have been developed having a special curved shape to reach around the lip to the underside of the toilet bowl rim. Moreover, some cleaning solution containers have been provided with a special angled or "duck neck" spout, to allow spraying or streaming of solution under the bowl lip. However, these devices have not solved the problem entirely.

In situations where toilets use water containing high levels of sediment or other impurities, particularly dissolved minerals such as iron and calcium, a stain or scale may form on the bowl surface. Over time, this scale may become thickened, and it is extremely difficult to remove. In such cases, cleaning generally requires the use of both a cleaning solution and an abrasive device such as a pumice stone or brick to manually abrade the scale from the bowl surface. It is sometimes necessary to chip or scrape using a metal blade to remove the deposit. Sometimes it is impractical to attempt to clean the toilet bowl, because of the time and effort that would be involved. In that case the toilet bowl must be either left in an unsightly state or replaced, neither of which is desirable. At the very least, removal of such deposits is a very unpleasant and time-consuming task.

Another problem associated with toilet cleaning is the safety hazard posed by many cleaning solutions. These solutions are usually either acidic or caustic. In situations involving removal of severe scale, the cleaning solution used may be required to be extremely acidic, for example, containing hydrochloric, hydrofluoric or other aggressive acids. Working with such strong chemicals, the cleaning task is made more unpleasant because the use of chemical-resistant gloves and eye-protecting goggles is required. Furthermore, inhalation of fumes from these cleaning solutions must be avoided, which also complicates the task.

It has been recognized that stain and scale removal can be enhanced by lengthening the time that cleaning solutions are in contact with the stain, and some cleaning products have been provided with a thick syruplike consistency. The intent is to cause the cleaning solution to cling to the surfaces of the toilet bowl, rather than drain quickly to the bottom of the bowl. Some improvement in cleaning effectiveness is achieved by this method, but it has been recognized that exposure tinge is still inadequate for removal of severe scale. Most cleaning solution manufacturers direct that two, three or more applications of solution may be required. These repeated applications implicate more manual effort, and consume more cleaning solution. Thus, the amount of labor, and cleaning solution costs, associated with this commonly required task remain high.

Hence those concerned with the art have recognized that it would be desirable to be able to routinely clean toilet bowls in a manner that would avoid the unpleasant aspects of the task, including the need to scrub the bowl with a brush or other abrasive device, and the tedious manual labor associated with scraping scale from the bowl surface. It has been recognized that it would be desirable to limit human contact with potentially hazardous acidic and caustic cleaning solutions, and with disease contaminated surfaces, and yet to provide thorough cleaning of remote interior bowl surfaces. It has also been recognized that it would be desirable to clean stained and scaled bowls in situations where the deposition is so severe that cleaning by manual and/or abrasive and chemical means is impractical. The present invention fulfills these needs.

SUMMARY OF THE INVENTION

This invention concerns an apparatus for routine toilet bowl cleaning. By means of a recirculating pump adjustably and removably supported within a toilet bowl, a cleaning fluid is pumped from a bottom portion of the toilet bowl and sprayed against the interior walls of the bowl. Rebounding off the bowl surface, the fluid is dispersed over all the toilet bowl interior surfaces. The pump sprays the solution against the bowl surface at a level or location in the bowl such that solution strikes the surface at an angle, causing some solution to be deflected upward. This upward deflection causes solution to strike and clean the surfaces under the lip of the rim of the bowl. Solution not deflected upward runs down and cleans the lower bowl surfaces. Ultimately, all solution returns to the bottom of the bowl where it is again drawn into the impeller and sprayed against the bowl surface. This recirculation continues, maintaining a continuous contact of cleaning solution with interior bowl surfaces as long as required for complete cleaning. In extraordinary cases involving severe stain or scale, recirculation is simply maintained for a longer period, without human intervention.

The powered cleaning apparatus according to the invention has a cover or lid which fits across the top of the bowl. This cover both contains the sprayed solution and supports the recirculating pump, which may comprise, for example, an electric motor and impeller. The combined cover and pump apparatus rests on the top of the rim of the toilet bowl, the impeller hanging down into the toilet bowl with a bottom tip of the impeller located below the liquid surface in the bowl. The cover is made of transparent material so the user can observe the cleaning progress and determine when cleaning has been completed. The cover size and shape are designed so that the cover will fit on toilets of various sizes and shapes.

In addition to a cover that accommodates various toilet rim shapes, the apparatus is also adapted to accommodate various outlet sump or bottom discharge locations found in different toilet configurations. A pump support location in the cover is elongated to allow variable positioning of the pump assembly, thus accommodating the various bottom discharge locations. This variable motor location is achieved without loss of the seal necessary to contain the sprayed solution. Consequently, the invention may be moved from one toilet to another for cleaning.

Other aspects and advantages of the invention will become apparent from the following detailed description and the accompanying drawings, illustrating by way of example the features of the invention.

BRIEF DESCRIPTION OF THE DRAWINGS

FIG. 1 is a front elevational view, partially in section, of a powered cleaning apparatus according to the invention in a conventional toilet bowl;

FIG. 2 is a top view of various toilet bowl configurations and a cover configuration of the invention encompassing these shapes;

Figure 3:
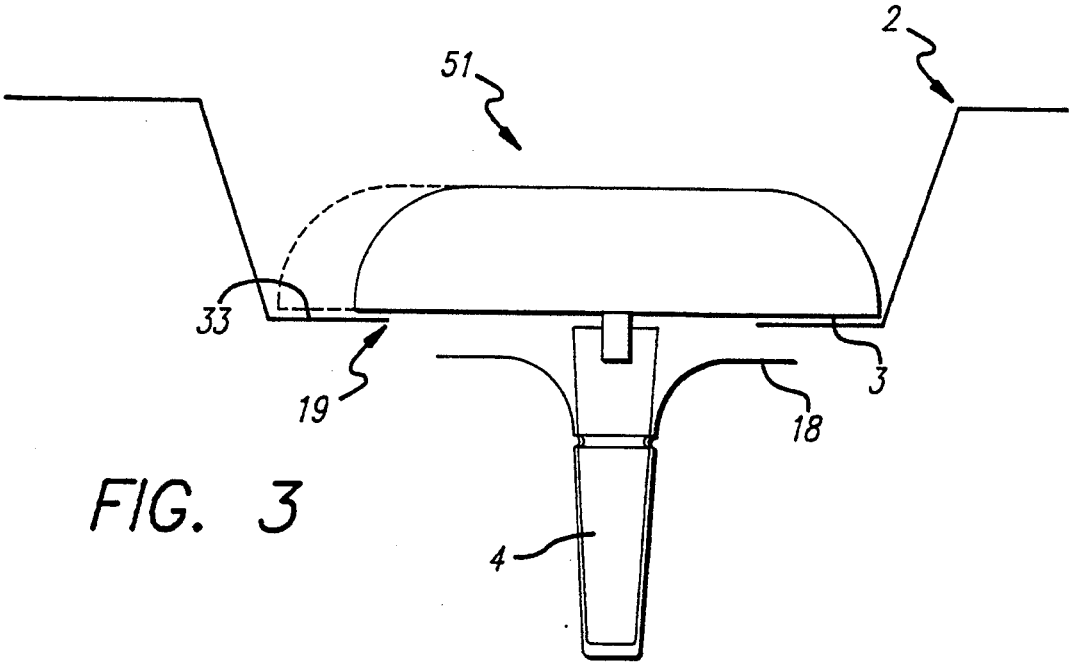
FIG. 3 is a side elevational view of an alternative embodiment of the powered cleaning apparatus of the invention.

FIG. *3a* is a top view of the apparatus shown in FIG. 3;

FIG. *3b* is a top view of a portion of the apparatus shown in FIG. *3a*, showing a further alternate embodiment;

FIG. *3c* is another top view of the apparatus shown in FIG. *3b*, wherein part of the apparatus is turned 180° from that shown in FIG. *3b;*

FIG. 4 is a front elevational view of a portion of an alternate embodiment of the apparatus of the invention; and FIGS. *5a, b, c,* and *d* are cross-sectional views of alternate embodiments of the apparatus shown in FIG. 4, taken along line 5—5 in FIG. 4.

DETAILED DESCRIPTION OF THE PREFERRED EMBODIMENTS

Referring now to the drawings, which are provided by way of illustration and example, and wherein like reference numerals designate like or corresponding elements among the several views, there is shown in FIG. 1 the top surface 1 of the toilet bowl on which rests the cover 2. The cover supports a recirculating pump 51, which comprises an assembly of a motor within a motor housing 3 and an impeller 4 with an impeller tip 5 and an associated solution metering hole 6 located below a bucket flush water level 7. Also shown is a normal water level 8. The features of the bowl are an interior surface 9, an under rim lip surface 10 and a discharge outlet port sump 11. The impeller 4 is attached to the motor assembly 3 by means of a delve member 12 which is a disk affixed to a motor drive shaft 13. Disk lugs 14 capture the impeller 4 against the drive member through corresponding mating holes in the impeller.

The powered cleaning apparatus of the invention cleans the bowl surface 9 which is above the water level in the bowl Cleaning of the surface below the water level is accomplished by the continuous contact of the cleansing solution. However, if cleaning chemicals are added to a toilet having a normal water level 8, significant dilution of the chemicals will occur, thus reducing the cleaning action both above and below the water level.

To avoid chemical dilution and provide more bowl surface 9 above the water level, it is desirable to lower the water level in the bowl. This can be accomplished by pouring a large quantity of water (a bucket full) into the toilet. A flush will occur and the water level will be lowered to a position just above the discharge port 11. If the toilet flush mechanism is not disturbed, the bowl will not refill, thus the water level will remain lowered at the bucket flush level 7.

With the water level lowered, cleaning chemicals can be added with relatively slight dilution. In addition, the lower bucket flush water level 7 causes more bowl surface 9 to be exposed for spray cleaning by the powered cleaning apparatus of the invention. This is particularly important in situations involving removal of mineral deposits, since many times there is a severe stain at the water level 8 of a normally filled bowl.

In using the currently preferred embodiment, the water level is first lowered from the normal level 8 to the bucket flush level 7 by pouring a bucket of water into the toilet. Cleaning chemicals are then added to the water remaining in the toilet. The cover 2 is placed onto the top surface 1 of the toilet and the recirculating pump 51, comprising the motor and impeller assembly 3 and 4, is then placed on the cover, with the impeller 4 extending through a portion of the cover defining a hole 19. The impeller tip 5 is positioned in the liquid cleaning solution florid 15 in the discharge outlet sump 11.

By energizing the electric motor of the motor assembly 3 the impeller 4 is caused to rotate about its vertical axis. The impeller consists of a hollow tapered tube, increasing in diameter from a lower tip 5 containing the metering hole 6 to a higher end attached to the drive member 12. The interior of this hollow impeller tube contains at least one vertical rib 16 protruding inward. As the impeller rotates, cleaning solution fluid which has entered the metering hole 6 is entrained by the interior vertical rib or ribs and the solution is caused to rotate with the impeller. Alternatively, the rib 16 could be replaced with an interior channel (not shown).

By means of well known forces associated with rotating bodies, the fluid rises in the increasing diameter of the impeller tube 4. Near its top, the impeller shape rapidly increases in diameter forming a large diameter disk portion 18. The fluid in the rotating impeller rises to the level of this disk, then accelerates in a radially outward direction as it spreads out onto the disk portion. Subsequently, as the fluid continues in a radial direction it is flung from the outer edge of the disk portion of the impeller (which comprises an outlet of the recirculating pump 51), spraying in all directions out from the vertical axis of the impeller in a circular pattern covering 360°. Fluid thus sprayed from the outlet of the pump 51 strikes the interior bowl surface 9, providing the dispersion and cleaning effects previously mentioned.

As will be apparent to one skilled in the art, other types of recirculating pumps 51 could be employed. Other means of spraying the interior bowl surfaces 9 could be used in combination with a recirculating pump. One of the advantages of the presently preferred type of recirculating pump described herein is that pumping and spraying action are combined in the function of the impeller 4.

The level of the disk portion 18 of the impeller 4 is preferably even with a vertically increasing diameter or shape of the bowl so that some of the liquid which strikes the interior bowl surface 9 is deflected upward. This deflection causes some cleaning solution fluid to strike the underside of the bowl lip 10 for cleaning in this difficult to reach location. Ultimately, all of the fluid discharged from the impeller disk 18 returns to the bottom of the toilet bowl at the discharge outlet port sump 11 where it is again picked up by the impeller and recirculated so as to be continuously sprayed against the interior toilet bowl surfaces for continuous cleaning.

As mentioned, the cover 2 rests on the top surface 1 of the toilet bowl and has a large hole 19 near the center of the bowl to allow adjustable placement of the motor and impeller assembly comprising the recirculating pump 51. The purpose of the cover is to both support the pump and to contain the cleaning solution fluid 15 as it is sprayed against the bowl surface 9. It is important that sprayed fluid not escape from the bowl during the cleaning process, both to avoid the loss of cleaning solution (thus ensuring availability of solution for recirculation) and to avoid human contact with the frequently hazardous cleaning chemicals that may be used. To provide this containment, the cover fits closely to the top surface 1 of the toilet bowl rim and tightly at an area 20 contacting and supporting the motor and impeller assembly 51.

A cover 2 is preferably formed of a plastic material. For example, glycol-modified polyethylene terephthalate (PETG), polyvinyl chloride (PVC), or vinyl may be used. In a currently preferred embodiment, a transparent cover may be formed of PETG, to allow observation of the interior of the toilet bowl when cover 2 is in place. Advantages of a transparent cover include easier placement of the lower tip 5 of the impeller 4 within the discharge outlet sump 11, and also being able to observe the cleaning process.

Toilets are manufactured in a variety of shapes. FIG. 2 shows common toilet shape variations. The interior bowl opening may be generally round 21 or may have a more elongated front shape 22. The exterior edge location 23 follows the interior shape providing the necessary rim thickness resulting in a longer 24 or shorter 25, toilet bowl configuration.

Also, the location of the discharge port outlet sump 11 varies among toilets. Some ports are located near the back of the bowl 26, some slightly forward 27 and others near the center or even more forward 28.

Locations of toilet seat mounting holes 29 and 30 also vary. Most mounts 29 are located less than six inches apart. However, some mounts 30 are farther apart. The shape of the cover 2 of the invention fits both the round 21 and elongated 22 toilet bowl shapes to contain cleaning solution spray.

Figure 3A:
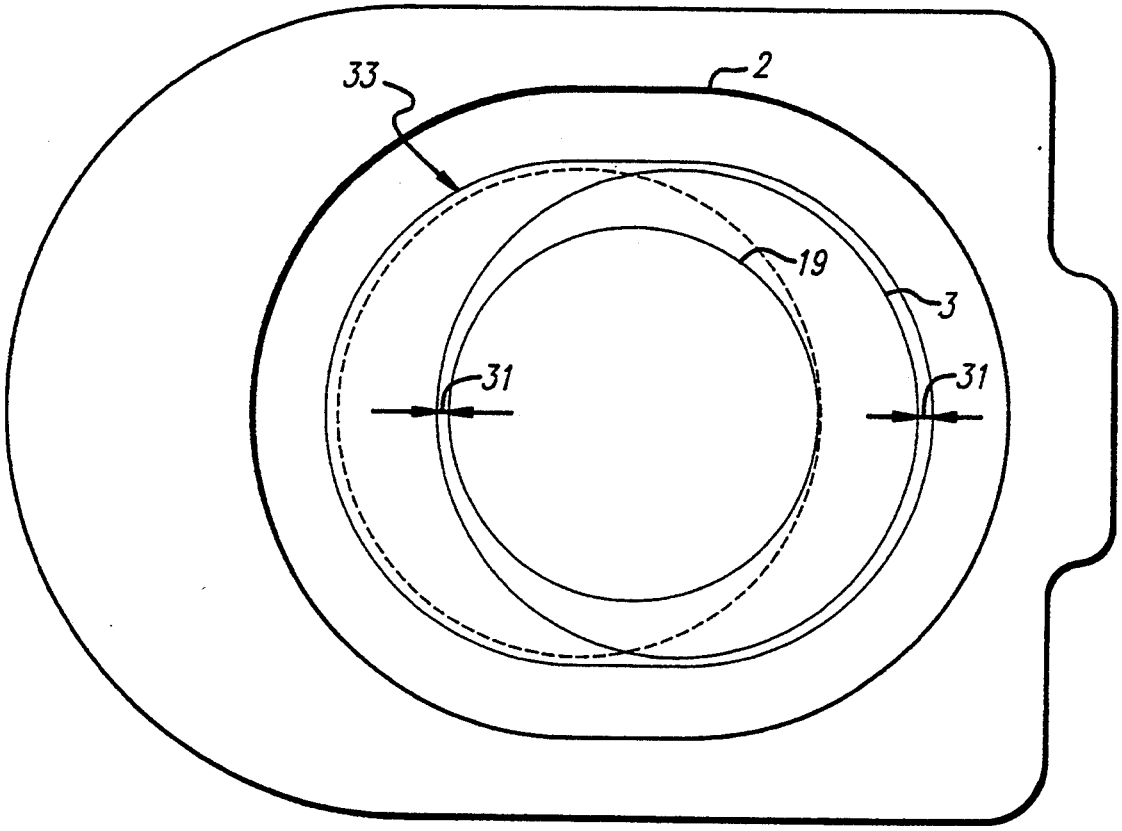

As shown in FIGS. 3 and 3*a*, the configuration of the cover 2 provides for support of the recirculating pump 51. The opening 19 in the cover is just slightly larger in diameter than the impeller disk 18, and thus the impeller 4 can be positioned through and below the cover when the motor and impeller assembly comprising the recirculating pump 51 are placed onto the cover. The diameter of the motor assembly housing 3 is larger than the impeller opening 19 so the motor housing rests on the cover 2, providing an overlapping contact area 3l to contain the cleaning solution spray.

The motor and housing assembly 3 is conventional. In a currently preferred embodiment, a conventional alternating current motor of "C-frame" design (not shown), manufactured by Jakel, Inc. of Highland, Ill., is incorporated into a plastic motor housing. The motor housing may be formed, for example, of polystyrene or polypropylene. The motor housing accommodates a handle 53 for easier handling and placement of the recirculating pump 51. Ventilation of the motor is accommodated by vents 55 formed in the motor housing.

Alternatively, a direct current motor might be used, powered by a conventional AC to DC converting power supply. As another alternative, batteries may be used as the power source, which batteries may be incorporated within the motor housing assembly 3.

When the motor and impeller assembly comprising the recirculating pump 51 is resting on the cover 2, the impeller disk portion 18 is located below the underside of the cover. The shape of the cover in the area where the motor housing 3 rests is elongated so that the motor housing can be moved forward and back as it is supported by the cover. This allows proper positioning of the motor and impeller assembly comprising the recirculating pump 51 to place the impeller tip 5 within the discharge outlet port 11. The distance the motor and impeller assembly can travel is limited by a flat depressed area 33 in the cover 2, so the fit of the motor housing 3 to the hole 19 in the cover always maintains the necessary seal width of the overlapping contact area 31 for spray containment.

FIGS. 3 and 3*a* show the motor housing 3 at a first position at a limit of movement towards a first end of the flat depressed area 33 in the cover. A second position of the motor housing at a limit of movement towards a second, opposite, end of the flat depressed area is shown in a dashed line in the figures. The motor housing can be positioned at any point intermediate these two positions.

FIGS. 3*b* and 3*c* show a alternative embodiment of the motor housing assembly 3. FIG. 3*b* shows a motor housing 3, which as an elongated circle shape, at a first position at a limit of movement towards a first end of the flat depressed area 33 in the cover. The axis of the impeller 4 is located at the center of radius of one side of the elongated circular motor housing. A second position of the motor housing at a limit of movement towards a second, opposite, end of the flat depressed area is shown in a dashed line in the figures. The motor housing can be positioned at any point intermediate these two positions.

FIG. 3*c* shows the elongated circle motor housing 3 positioned, relative to the depressed area 33, in an orientation 180° from that shown in FIG. 3*b*; and the configuration provides for similar positioning and travel as shown in FIG. 3*b*. The ability to lift and rotate the motor housing to change between the two orientations shown in FIGS. 3*b* and 3*c* provides a full range of travel as discussed in connection with the motor housing shown in FIG. 3*a* previously.

This elongated configuration of the motor housing assembly 3 is advantageous, as it prevents rotation of the housing relative to the cover 2 due to torque forces on the housing. For example, such rotational forces may be occasioned by start-up of the motor. FIGS. 3*b* and 3*c* show the flat depressed area 33 as an elongated circle having a straight shape portion 57. By engagement of the straight shape portion 58 of the motor housing with the straight shape portion 57 of the depressed area, the motor housing is retained by and can not rotate relative to, the cover 2.

As an alternative to the impeller design having vertical ribs 16 on the interior wall of the tapered tube of the impeller 4 as previously presented, other means of providing vertical channels will provide the same result. For example, referring to FIGS. 4 and 5*a*, 5*b*, 5*c* and 5*d*, a drive member comprising a tapered spindle 35 configured to fit inside the tapered tube of the impeller 4 is shown. The spindle has vertical grooves or flats on its exterior. Channels 39, 40, 41 or 42 for passage of cleaning fluid are thus formed between the impeller tube and spindle.

The tapered spindle 35 is attached to the motor drive shaft 13 by set screw, force fit or other conventional means (not shown). The spindle has a ring of reduced diameter 36 which engages a reduced diameter ring 37 in the impeller 4. An annular lip 44 is provided below the ring 36, protruding out about 10 mils (0.025 centimeter) from the spindle. The annular lip assists in retaining the impeller on the spindle. These rings 36, 37 may be complete or interrupted rings, or may both be interrupted in a manner to provide interlocking to assure positive rotational engagement between the spindle and impeller. By means of this engagement of the impeller ring into the spindle ring and a snug fit between the spindle and impeller, the impeller is retained by and rotates with the spindle when the motor is energized.

On the outside surface of the spindle 35 are longitudinal grooves or channels extending the full length of the taper, passing through the ring 36. These grooves are either flats 39, rectangular 40, "V" shaped 41, large notches 42 or other shapes to provide vertical channels for cleaning solution fluid passage. Shown in FIGS. 5*a*, *b* and *c* are two grooves, but one, two or more grooves could provide the solution pathway. For example, four grooves 42 are shown in FIG. 5*d*.

In a manner similar to that previously described, cleaning solution enters the impeller 4 through the metering hole 6 at the impeller tip 5. The spindle 35 does not extend to the tip of the impeller, allowing a clearance space 43 for the solution to enter. As the impeller and spindle rotate together, cleaning solution is entrained by the grooves on the outside of the spindle. Again, by means of well known rotational forces, cleaning fluid rises in the increasing diameter of the impeller. As solution reaches the top of the impeller, it spreads out onto the increasing diameter of the impeller disk portion 18 and is accelerated and flung from the impeller disk and onto the bowl surface 9. This provides for cleaning as described above.

In both embodiments, the impeller 4 is releasably secured to the drive member which is a disk 12 in the first described embodiment, or a spindle 35 in the second embodiment. The impeller can be made to be disposable as a consequence, to allow for easier cleaning of the device after each use. This also would be advantageous in terms of disease control, as a new and sanitary impeller could be used in each cleaning and afterwards immediately discarded.

Whether the impeller is made to be disposable or not, it is currently preferred to form the impeller out of a plastic material. An impeller formed of PETG is currently preferred, as an impeller formed of this material can be made at very low cost due to its high strength, even at small wall thicknesses.

Also, in both embodiments, the driving member comprising the disk 12 attached to the drive shaft 13, or the spindle 35 likewise is attached to the drive shaft, are formed of plastic material. For example, it is currently contemplated that the motor drive disk 12 or spindle 35 be formed of an acrylic plastic material, polypropylene, or an acetal resin such as Delrin (a trademark of E. I. DuPont de Nemours & Co.).

Additionally, the cover 2, formed of PETG, could be made to be disposable. This would also be advantageous in providing for easy clean-up of the device after use. Again, a new, sanitary, cover 2 could be used and thereafter discarded. It has been found that in forming a cover using PETG, a cover material thickness of about 40 mils (0.1 centimeter) works well in supporting the recirculating pump 51.

Although specific embodiments of the invention have been described and illustrated, it will be apparent that the invention is susceptible to numerous modifications and embodiments within the ability of those skilled in the art, without the exercise of the inventive faculty.- Thus, it should be understood that various changes in form, detail and application of the present invention may be made without departing from the spirit and scope of the invention.

What is claimed is:

1. A powered cleaning apparatus for cleaning an interior surface of a toilet bowl, said toilet bowl having a rim portion defining an upper opening of the bowl, and the bowl containing a cleaning fluid, the apparatus comprising: a recirculating pump having an inlet and an outlet, removably positioned in relation to the toilet bowl so that the inlet is disposed in the cleaning fluid, the pump operable to convey the cleaning fluid from its inlet and apply the cleaning fluid to the interior surface of the bowl through its outlet above a fluid surface defined by the cleaning fluid in the bowl; a cover enclosing the upper opening of the bowl; said cover being supported by said rim and said recirculating pump being carried by said cover.

2. The powered cleaning apparatus of claim 1, wherein the outlet faces, for a period of time, each portion of the interior surface above the fluid level in the bowl, around the circumference thereof, and the pump is operable to spray the cleaning fluid onto the interior surface through its outlet.

3. The powered cleaning apparatus of claim 2, wherein the interior surface is located at a first location within the bowl and the pump is operable to convey cleaning fluid to a second surface portion at a second location in the bowl with a selected force so that the cleaning fluid is deflected by the second surface and directed to the interior surface.

4. The powered cleaning apparatus of claim 1, wherein the cleaning apparatus is transportable from a first toilet bowl to a second toilet bowl.

5. A powered cleaning apparatus for cleaning an interior surface of a toilet bowl, said toilet bowl having a rim portion defining an upper opening into the bowl and containing cleaning fluid, comprising: a cover member having a size which is larger than the opening and is adapted to being placed over the opening and supported by the rim portion; a recirculating pump adapted to be adjustably supported within the toilet bowl by said cover member, said pump being capable of conveying cleaning fluid from a bottom portion of said toilet bowl to an interior surface within said toilet bowl to maintain a presence of cleaning fluid thereon.

6. The powered cleaning apparatus of claim 5, wherein the cleaning fluid is sprayed against the interior surface within said toilet bowl.

7. The powered cleaning apparatus of claim 6, wherein the cleaning fluid is deflected by a surface within said toilet bowl to strike a surface underneath a lip of the rim portion.

8. The powered cleaning apparatus of claim 6, wherein the cleaning fluid is sprayed in a circular pattern.

9. The powered cleaning apparatus of claim 8, wherein the recirculating pump is of the type employing a centrifugal impeller rotating about a vertical axis, said impeller having a first end of smaller diameter at a lower elevation and a second end of larger diameter at a higher elevation, and means for imparting a circular motion to fluid disposed therein, for drawing fluid up within said impeller from the first end to the second end and ejecting the fluid from the second end.

10. The powered cleaning apparatus of claim 9, wherein the recirculating pump includes a drive means and the impeller is releasably secured to said drive means.

11. The powered cleaning apparatus of claim 10, wherein the impeller is disposable.

12. The powered cleaning apparatus of claim 5, wherein the cover is disposable.

13. The powered cleaning apparatus of claim 5, wherein the cover is transparent to allow viewing the interior of the bowl during cleaning.

14. The powered cleaning apparatus of claim 5, wherein the recirculating pump is electrically powered.

15. The powered cleaning apparatus of claim 5, wherein the apparatus is transportable from a first toilet to a second toilet.

16. The powered cleaning apparatus of claim 5, wherein the cover is adapted to engage the rim portion of toilets of two or more sizes.

17. An electrically powered cleaning apparatus for cleaning a toilet bowl of the type having a rim portion having a lip with an upper side and an underside, and a discharge outlet sump portion, and a bowl-shaped portion intermediate the discharge outlet sump portion and the lip or the rim portion, said toilet bowl being adapted to contain a cleaning fluid, comprising:

a transparent cover member having a rim portion and a depressed flat recirculating pump support portion which extends downwardly into the toilet bowl, the rim portion being adapted to engage the rim portion of at least two sizes of toilet bowls and the flat support portion having a circular portion defining a circular opening therethrough;

a recirculating pump motor and housing, adapted to be adjustably received within and supported by the flat supporting portion of said cover member, the recirculating pump motor having a rotating shaft which extends through the circular opening in said cover member;

a driving member, which is fixedly attached to the shaft of said recirculating pump motor; and an impeller, which is releasably attached to the driving member, which is adapted to extend into the discharge outlet sump portion of a toilet bowl when the recirculating motor and cover portion are supported by the rim of a toilet bowl and properly adjusted in position, the impeller having a metering port portion, an increasing diameter portion, and a horizontal disk portion and means for imparting a circular motion to cleaning fluid within said impeller;

whereby cleaning fluid is drawn from the discharge outlet sump portion through the metering port portion and is lifted up within the increasing diameter portion of said impeller and then travels radially outwardly along the horizontal disk portion of said impeller to spray in a circular pattern around the inside of the bowl-shaped portion of a toilet bowl, and the cleaning fluid is deflected by the bowl-shaped portion, in an upward direction to contact the underside of the lip of the rim portion of the toilet bowl, the cleaning solution being confined to the toilet bowl by said cover member, and cleaning fluid flowing back to the discharge outlet sump portion for recirculation to continuously spray cleaning fluid onto interior bowl surfaces.

18. A powered cleaning apparatus for cleaning an interior surface of a toilet bowl, said toilet bowl having a rim portion defining an upper opening of the bowl, and the bowl containing a cleaning fluid, the apparatus comprising:

a recirculating pump having an inlet and an outlet, removably positioned in relation to the toilet bowl so that the inlet is disposed in the cleaning fluid, the pump operable to convey the cleaning fluid from its inlet and apply the cleaning fluid to the interior surface of the bowl through its outlet;

a cover having a size which exceeds the upper opening of the bowl, said cover disposed over the opening; the cover being supported by the rim of said toilet bowl and the recirculating pump being carried by the cover.

19. The powered cleaning apparatus of claim 18, wherein the interior surface is located under a lip of the rim portion and the pump is operable to convey cleaning fluid to a second surface in the bowl with a selected force so that the cleaning fluid is deflected by the second surface and directed to the interior surface.

20. The powered cleaning apparatus of claim 18, wherein the cleaning apparatus is transportable from a first toilet bowl to a second toilet bowl.

* * * * *